US007677865B2

(12) United States Patent
Han et al.

(10) Patent No.: US 7,677,865 B2
(45) Date of Patent: Mar. 16, 2010

(54) AIR PURIFIER

(75) Inventors: Jae Oh Han, Yongin-Si (KR); Jai Kwon Lee, Suwon-Si (KR); Jin Yong Mo, Anyang-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 452 days.

(21) Appl. No.: 11/270,554

(22) Filed: Nov. 10, 2005

(65) Prior Publication Data

US 2006/0291999 A1 Dec. 28, 2006

(30) Foreign Application Priority Data

Jun. 23, 2005 (KR) ..... 10-2005-0054449

(51) Int. Cl.
*F04D 29/44* (2006.01)

(52) U.S. Cl. ..... 415/119; 415/184; 415/205

(58) Field of Classification Search ..... 415/119, 415/184, 203, 204, 205, 206, 208.1
See application file for complete search history.

(56) References Cited

U.S. PATENT DOCUMENTS

| | | | | |
|---|---|---|---|---|
| 820,398 | A * | 5/1906 | Davidson | 415/204 |
| 820,399 | A * | 5/1906 | Davidson | 415/204 |
| 2,368,343 | A * | 1/1945 | Buskirk | 55/439 |
| 3,824,028 | A * | 7/1974 | Zenkner et al. | 415/58.6 |
| 5,570,996 | A * | 11/1996 | Smiley, III | 415/204 |
| 6,299,409 | B1 * | 10/2001 | Matsunaga et al. | 415/206 |
| 6,695,577 | B1 * | 2/2004 | Susek | 415/121.2 |
| 7,195,450 | B2 * | 3/2007 | Takamatsu | 415/119 |
| 2003/0202877 | A1 * | 10/2003 | Kamiya et al. | 415/206 |
| 2004/0146395 | A1 * | 7/2004 | Uselton | 415/119 |
| 2007/0116559 | A1 * | 5/2007 | Higashida | 415/206 |

FOREIGN PATENT DOCUMENTS

| | | |
|---|---|---|
| JP | 11-132191 | 5/1999 |
| JP | 2000-18198 | 1/2000 |
| JP | 2000-179496 | 6/2000 |
| JP | 2000-205621 | 7/2000 |
| JP | 2001-82394 | 3/2001 |
| JP | 2005-69610 | 3/2005 |
| KR | 20-0273754 | 4/2002 |

* cited by examiner

*Primary Examiner*—Edward Look
*Assistant Examiner*—Nathaniel Wiehe
(74) *Attorney, Agent, or Firm*—Stanzione & Kim LLP

(57) ABSTRACT

An air purifier includes a bell-mouth having an enhanced structure to prevent an increase of noise at a particular frequency when air flows into the blowing fan through the bell-mouth. The air purifier includes a housing, a filter unit and a blowing fan placed inside the housing, and a bell-mouth placed toward an intake side of the blowing fan. The bell-mouth includes an inlet port formed at a center of the bell-mouth, a flow guide extending from a periphery of the inlet port toward the blowing fan, and a flat section positioned to discontinue the flow guide to increase a distance between the blowing fan and the bell-mouth. The flat section is formed at the section in the range of about 240°~330° with respect to a starting point of a scroll inside the bell-mouth. The flat section may have a saw-tooth shape to effectively distribute air passing therethrough.

14 Claims, 5 Drawing Sheets

AIR PURIFIER

CROSS-REFERENCE TO RELATED APPLICATIONS

This application claims the benefit under 35 U.S.C. §119 from Korean Patent Application No. 2005-54449, filed on Jun. 23, 2005 in the Korean Intellectual Property Office, the disclosure of which is incorporated herein in its entirety by reference.

BACKGROUND OF THE INVENTION

1. Field of the Invention

The present general inventive concept relates to an air purifier, and more particularly, to an air purifier, which comprises a bell-mouth having an enhanced structure toward an intake side of a blowing fan to prevent a high level of noise at a particular frequency.

2. Description of the Related Art

Generally, an air purifier comprises a filter unit to purify air and a blowing fan to forcibly blow the air within a housing. When the air purifier is operated to purify indoor air, the blowing fan forces the indoor air to pass through a filter unit to filter dust, odor and bacteria from the air therethrough, and then forces purified air to be discharged into a room space.

The air purifier must have a compact structure for convenient installation in the room space, and a high purifying capability. Therefore, the air purifier has the filter unit placed close to the blowing fan within the housing. A bell-mouth placed toward an intake side of the blowing fan increases the amount of air circulated through the air purifier.

A conventional air purifier having the bell-mouth is disclosed in Korean Utility Model Registration No. 20-0273754. The bell-mouth is placed toward an intake side of a blowing fan, and has an inlet port formed at a center thereof. The inlet port has a flow guide formed at an edge to extend toward the blowing fan.

However, if the bell-mouth constructed as described above is included in the air purifier having the filter unit very close to the blowing fan within the housing, an unpleasant excessive noise is generated at a particular frequency when air passes through the bell-mouth.

SUMMARY OF THE INVENTION

The present general inventive concept provides an air purifier, which comprises a bell-mouth having an enhanced structure to prevent generation of an excessive level of noise at a particular frequency when air flows to a blowing fan through the bell-mouth.

Additional aspects and/or advantages of the general inventive concept will be set forth in part in the description which follows and, in part, will be obvious from the description, or may be learned by practice of the general inventive concept.

The foregoing and/or other aspects and advantages of the present general inventive concept are achieved by providing an air purifier, including a housing, a filter unit and a blowing fan inside the housing, and a bell-mouth placed toward an intake side of the blowing fan, wherein the bell-mouth includes an inlet port formed at a center of the bell-mouth, a flow guide extending from a periphery of the inlet port toward the blowing fan, and a flat section positioned to discontinue the flow guide in a section to increase a distance between the blowing fan and the bell-mouth.

The flat section may be formed at the section of the flow guide where air flows at a relatively high speed through the inlet port of the bell-mouth.

The flat section may be formed at the section in the range of approximately 240°~330° with respect to a starting point of a scroll inside the bell-mouth.

The flat section may have a saw-tooth shape to distribute the air passing therethrough.

The flow guide may extend a length of about 5 mm from the periphery of the inlet port.

The blowing fan may include a centrifugal fan.

The foregoing and/or other aspects and advantages of the present invention general inventive concept may also be achieved by providing an apparatus to purify air inside a room including a filter to purify air passing therethrough, a fan to force the air to pass through the filter, and a bell-mouth disposed between the filter and the fan to guide the air toward the fan, the bell-mouth including a semicircular flange portion extending toward the fan to provide a first distance between the bell-mouth and the fan, and a semicircular flat portion completing a circle with the semicircular flange portion to provide a second distance between the bell-mouth and the fan.

The foregoing and/or other aspects and advantages of the present invention general inventive concept may also be achieved by providing a flow guide to lower the noise when guiding an air flow to a fan including a main guide portion to guide the air flow toward the fan, the main guide portion having a semicircular flange portion to cause a first distance to be maintained between the fan and the main guide portion, and a secondary guide portion positioned where the air flow rate through the fan is greater, the secondary guide portion having a semicircular flat portion completing a circle with the semicircular flange portion such that the distance between the fan and the secondary guide portion where the secondary guide portion is positioned is greater than the first distance.

The foregoing and/or other aspects and advantages of the present invention general inventive concept may also be achieved by providing an air flow control apparatus including a circular plate shaped body, a circular inlet hole formed through a center portion of the circular plate, and a flow guide extending around a predetermined portion of an inner edge of the circular plate where the circular inlet hole is formed.

BRIEF DESCRIPTION OF THE DRAWINGS

These and/or other aspects and advantages of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
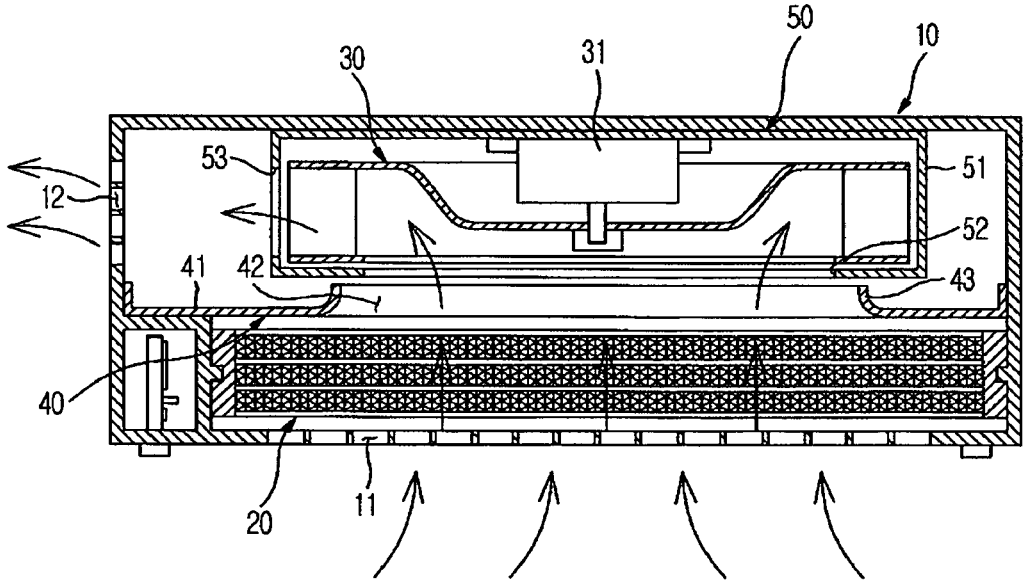
FIG. 1 is a cross-sectional view illustrating an air purifier in accordance with an embodiment of the present general inventive concept.

Reference will now be made in detail to the embodiments of the present general inventive concept, examples of which are illustrated in the accompanying drawings, wherein like reference numerals refer to like elements throughout the description. The embodiments are described below to explain the present general inventive concept while referring to the figures.

Figure 2:
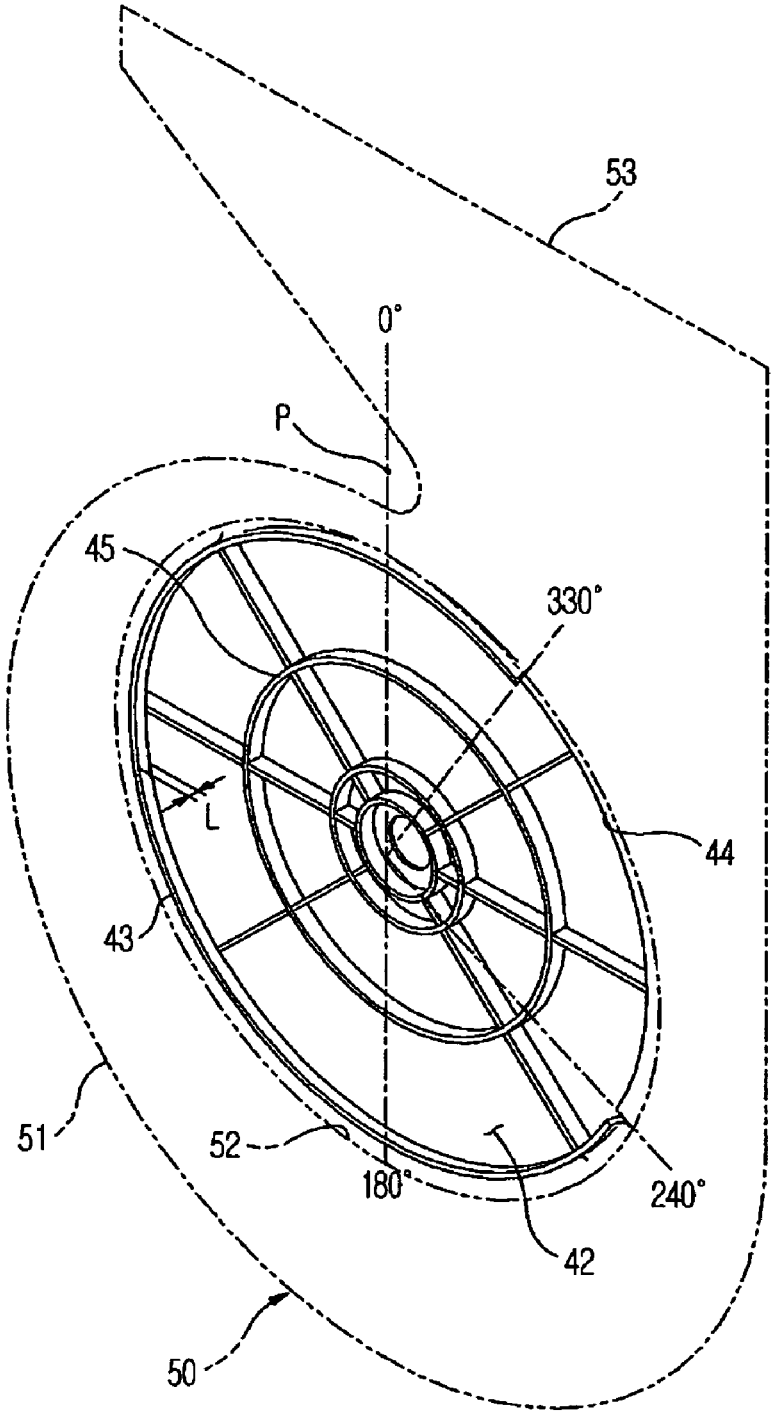
FIG. 2 is a perspective view illustrating a bell-mouth in accordance with the embodiment of the present general inventive concept.

FIG. 1 is a cross-sectional view illustrating an air purifier according to an embodiment of the present general inventive concept, and FIG. 2 is a perspective view illustrating a bell-mouth according to the embodiment of FIG. 1.

As illustrated in FIGS. 1 and 2, the air purifier according to the present embodiment includes a box-shaped housing 10 defining an appearance of the air purifier, a filter unit 20 disposed inside the housing 10 to purify air, a blowing fan 30 disposed above the filter unit 20 within the housing to forcibly blow the air, and a bell-mouth 40 positioned between the filter unit 20 and the blowing fan 30 to guide the air to smoothly flow toward the blowing fan 30.

A plurality of air inlets 11 through which indoor air flows into the housing 10 are formed at the bottom of the housing 10, and a plurality of air outlets 12 through which purified air is discharged to a room space are formed on one side of the housing.

The air inlets 11 and the air outlets 12 may be placed on a front surface and an upper surface of the housing 10, respectively, depending on an arrangement of the filter unit 20 and the blowing fan 30 within the housing 10.

Since the filter unit 20 has a structure which includes various types of filters including a dust collecting filter, an anti-bacterial filter, and a deodorization filter that are compactly combined within the structure, the filter unit 20 can effectively remove dust, bacteria and odors present in the air.

The blowing fan 30 can be one of a centrifugal fan having a plurality of radially arranged fans, such as a Sirocco fan, which rotates at a high speed by a driving motor 31. However, the blowing fan 30 is not limited to a particular type of fan, but may be any fan that performs the intended purpose of the general inventive concept. The blowing fan 30 forces the indoor air to flow into the housing 10 and to circulate therein.

The blowing fan 30 is placed inside a fan casing 50. The fan casing 50 includes a lower portion with a substantially circular scroll 51, which has an intake port 52 formed at a lower center of the scroll 51 and a discharge port 53 formed on the circular scroll in a position facing the air outlets 12.

In order to conveniently transport and install the air purifier, the housing 10 is made as compact as possible, and, consequently, the filter unit 20 and the blowing fan 30 are located close to each other within the housing 10.

The bell-mouth 40 is placed between a rear side of the filter unit 20 and an intake side of the blowing fan 30 to guide air purified through the filter unit 20 to smoothly flow into the fan casing 50.

The bell-mouth 40 includes a base plate 41 having a predetermined size, a substantially circular inlet port 42 formed at the center of the base plate 41, a flow guide 43 extending from a periphery of the inlet port 42 toward the blowing fan 30, and a flat section 44 formed by cutting off a section of the flow guide 43. That is, the flow guide 43 has a discontinuous section corresponding to a length of the flat section 44.

The upper, lower, left and right ends of the base plate 41 are fixed to upper, lower, left and right ends of the housing 10, respectively, and the inlet port 42 has a diameter corresponding to a diameter of the intake port 52 of the fan casing 50 having the blowing fan 30 equipped therein. A grill 45 is formed in the inlet port 42 to reinforce the base plate 41 while allowing the air to stably flow into the bell-mouth 40 through the inlet port 42.

The flow guide 43 extends for a predetermined length in a round shape toward the intake port 52 of the fan casing 50 in order to allow the air that entered the housing 10 through the plurality of air inlets 11 to effectively flow into the fan casing 50.

Typically, since the air purifier has a compact structure, the filter unit 20 and the fan casing 50 are located close to each other within the housing 10. Therefore, the flow guide 43 may have an extension length L of 5 mm or more in order to smoothly guide the air into the fan casing 50.

In contrast with a conventional bell-mouth, in which a flow guide is formed around an entire periphery of an inlet port to have a continuous round surface, spacing between the conventional flow guide and a fan casing is generally small, so that air can be guided. However, in this case, there is a problem in that noise is considerably increased at a particular frequency as the air flow rate is increased.

According to the embodiments of the present general inventive concept, the flat section 44 is formed to discontinue the circular shape of the flow guide 43, and acts to separate the bell-mouth 40 by a relatively large distance from the fan casing 50, thereby overcoming the noise problem described above with respect to the conventional device. The flat section 44 may be located at a section of the circular inlet 42 where the air flows at a relatively high speed through the intake port 52 of the fan casing 50.

In practice, it has been observed that the air flowing into the fan casing 50 has a highest flow rate in the range of approximately 240°~330° with respect to a starting point P of the scroll 51 of the fan casing 50 having a substantially circular shape.

Accordingly, the flat section 44 acting as the discontinuous section of the flow guide 43 at the periphery of the inlet port 42 of the bell-mouth 40 is formed at a section in the range of about 240°~330° with respect to 0°, the starting point being located at P of the scroll 51, as illustrated in FIG. 2.

With the air purifier constructed as described above, when the blowing fan 30 is rotated at a high speed by operating the driving motor 31, indoor air flows into the housing 10 through the plurality of air inlets 11.

The air flow that enters into the housing 10 passes through the filter unit 20, where dust, bacteria and odor are removed from the air. Thereafter, the purified air flows into the inlet port 42 of the bell-mouth 40, and is guided along the flow guide 43.

The purified air guided along the flow guide 43 is taken into the blowing fan 30 as a smooth flow through the intake port 52 of the fan casing 50, and is then discharged into the room space after passing through the discharge port 53 of the fan casing 50 and the air outlets 12, so that the indoor air is purified.

Meanwhile, the air having an increased flow rate while passing through the section in the range of about 240°~330° from the starting point P of the scroll 51 of the fan casing 50 flows through the section where spacing between the bell-mouth 40 and the fan casing 50 is relatively large, i.e., the section where the flat section 44 is positioned and where the flow guide 43 is not formed. Thus, noise of a particular frequency which noise is otherwise generated when air passes at a high flow speed through a small gap is prevented.

Figure 3:
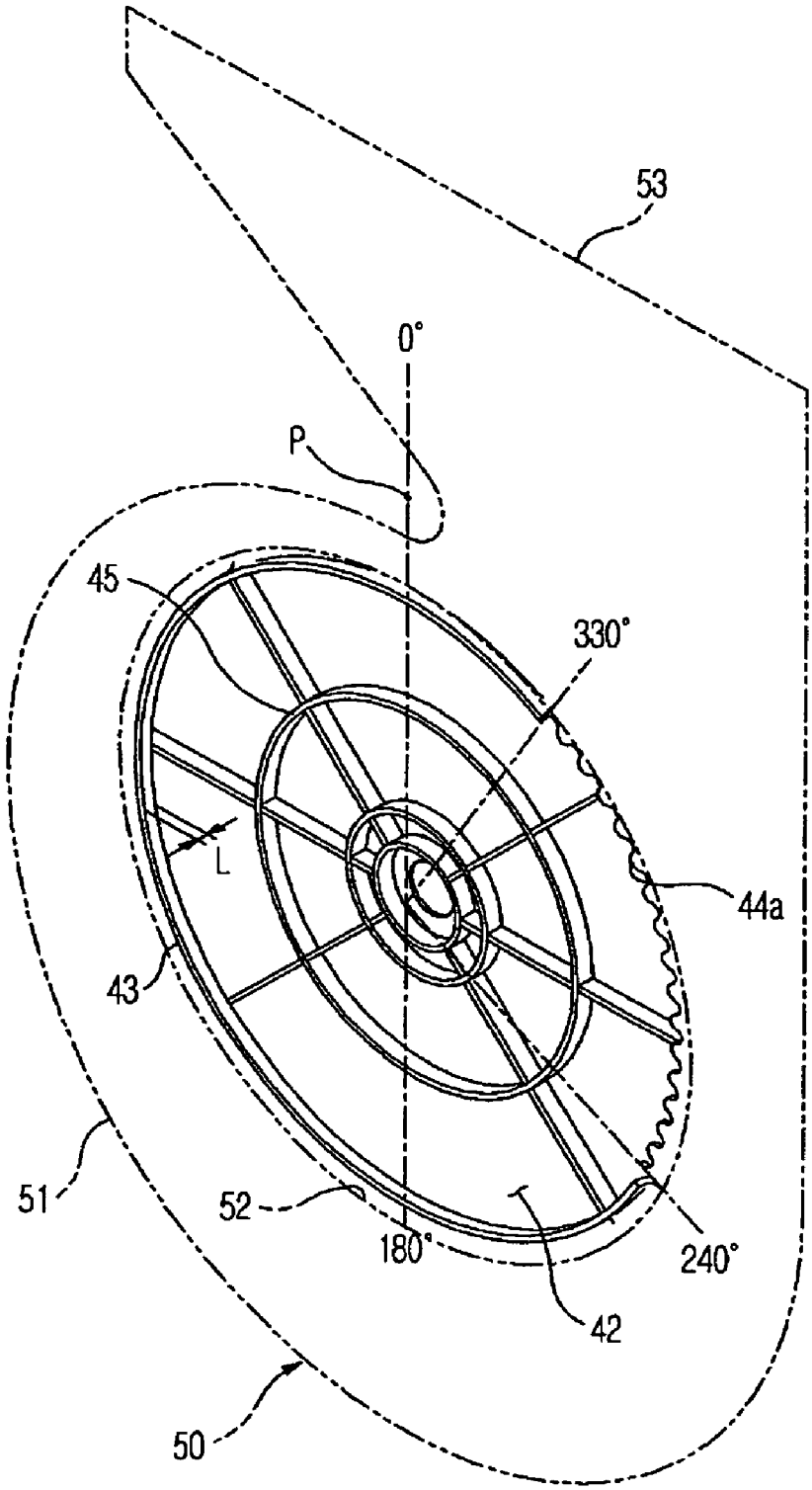
FIG. 3 is a perspective view illustrating a bell-mouth in accordance with another embodiment of the present general inventive concept.

FIG. 3 is a perspective view illustrating a flow-guide 43 and a flat section 44*a* of a bell-mouth according to another embodiment of the present general inventive concept. The bell-mouth of this embodiment includes the flat section 44*a* in the form of saw-tooth shaped semicircular portion. Accordingly, when the air flow passes through this flat saw-tooth section 44*a*, it becomes a turbulent flow, so that energy of a particular frequency is more effectively distributed, thereby further preventing generation of the noise having the particular frequency. Except for this structure, the bell-mouth of this embodiment has the same structure as that of the previous embodiment, and thus a more detailed description thereof will be omitted hereinafter.

Figure 4:
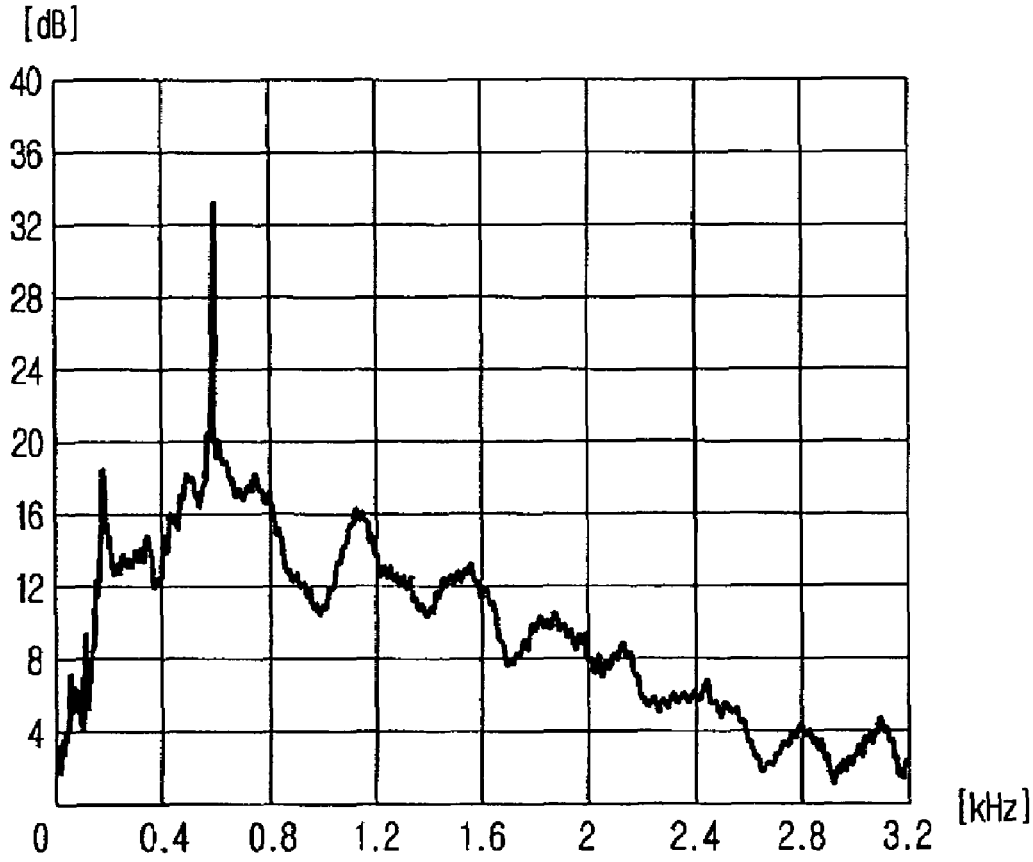
FIG.4 (PRIOR ART)
FIG. 4 is a graph illustrating the noise level as a function of frequency when an air purifier including a conventional bell-mouth is operated.
Figure 5:
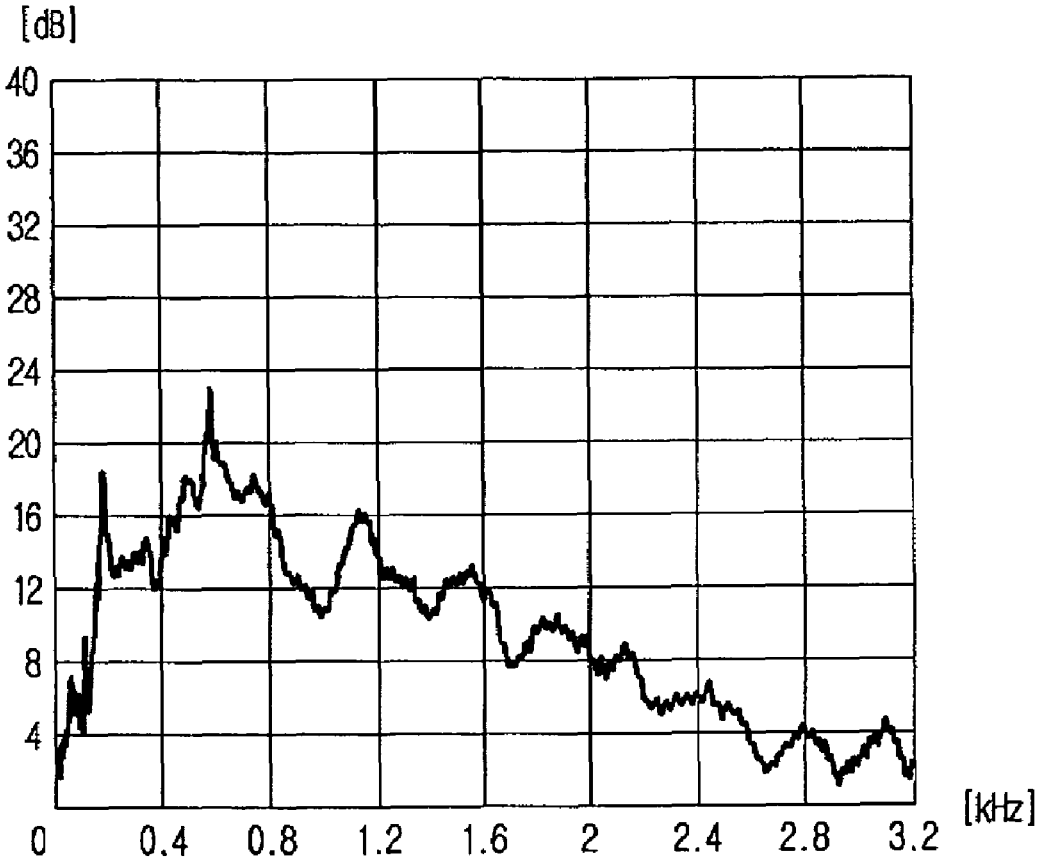
FIG. 5 is a graph representing the noise level as a function of frequency when an air purifier including the bell-mouth of the present general inventive concept is operated.

As illustrated by a comparison of FIGS. 4 and 5, an effect of the air purifier according to the embodiments of the present general inventive concept, which include the bell-mouth to suppress the noise of the particular frequency as described above, can be verified by measuring the noise level as a function of frequency (measuring the noise spectrum).

With regard to this, FIG. 4 is a graph illustrating the level of noise as a function of frequency when an air purifier including the conventional bell-mouth is operated, and FIG. 5 is a graph illustrating the level of noise as a function of frequency when an air purifier including the bell-mouth of the present general inventive concept is operated.

As illustrated in FIG. 4, when measuring the spectrum of the noise generated during the operation of the conventional air purifier comprising the bell-mouth in which the flow guide extends continuously along the periphery of the inlet port, a maximum noise level of about 33 dB is generated at a frequency of about 0.6 kHz, that is, the particular frequency herein.

In contrast, FIG. 5 illustrates the results of measuring the spectrum of the noise generated in the air purifier according to the embodiments of the present inventive concept. The embodiments whose noise spectrum is measured includes the bell-mouth 40 having the flat section 44 or the saw-tooth shaped flat section 44*a* in the range of about 240°~330° around the periphery of the inlet port 42, and the flow guide 43 extending on the remaining section. A maximum noise level of about 23 dB is generated at the frequency of about 0.6 kHz, the particular frequency herein. The noise level at the particular frequency for the embodiments of the present general inventive concept is 10 dB lower than the noise level at the particular frequency for the conventional air purifier.

As is apparent from the above description, the air purifier according to the embodiments of the present general inventive concept includes a bell-mouth located between a filter unit and a fan casing to prevent an increase in noise level at a particular frequency, so that the air purifier can be operated quietly and can provide a comfortable environment.

Although a few embodiments of the present general inventive concept have been shown and described, it would be appreciated by those skilled in the art that changes may be made in these embodiments without departing from the principles and spirit of the invention, the scope of which is defined in the claims and their equivalents.

What is claimed is:

1. An air purifier, comprising:

a housing;

a filter unit inside the housing;

a blowing fan inside the housing; and a bell-mouth placed toward an intake side of the blowing fan, wherein the bell-mouth includes an inlet port formed at a center of the bell-mouth, a flow guide extending from a periphery of the inlet port toward the blowing fan along a first peripheral section of the inlet port, and a flat section positioned along a second peripheral section of the inlet port to discontinue the flow guide to increase a distance between the blowing fan and the bell-mouth, wherein the first peripheral section is longer than the second peripheral section, wherein the flat section is formed at a section of the flow guide where air flows through the inlet port of the bell-mouth, and wherein the second peripheral section is formed in the range of about 240°~330° with respect to a starting point of a scroll inside the bell-mouth.

2. The air purifier according to claim 1, wherein the flat section has a saw-tooth shape to distribute air passing therethrough.

3. The air purifier according to claim 1, wherein the flow guide extends a length of about 5 mm from the periphery of the inlet port.

4. The air purifier according to claim 1, wherein the blowing fan is a centrifugal fan.

5. The air purifier of claim 1, wherein the length of the flat section is about a quarter the length of the flow guide.

6. An apparatus to purify air inside a room, comprising:

a filter to purify air passing therethrough;

a fan to force the air to pass through the filter; and a bell-mouth disposed between the filter and the fan to guide the air toward the fan, the bell-mouth including a semicircular flange portion extending toward the fan along a first peripheral section of the bell mouth to provide a first distance between the bell-mouth and the fan, and a semicircular flat portion completing a circle with the semicircular flange portion along a second peripheral section of the bell mouth to provide a second distance between the bell-mouth and the fan, wherein the first peripheral section is longer than the second peripheral section, wherein the semicircular flat portion is formed at a section of the first peripheral section where air flows through an inlet port of the bell-mouth, and wherein the second peripheral section is formed in the ranqe of about 240°~330° with respect to a starting point of a scroll inside the bell-mouth.

7. The apparatus according to claim 6, wherein the second distance is larger than the first distance.

8. The apparatus according to claim 6, further comprising:

a housing to enclose the filter, the fan and the bell-mouth, the housing including a plurality of air inlets to allow air to enter therein, and a plurality of air outlets to allow the air to be discharged from therefrom.

9. The apparatus according to claim 6, wherein the semicircular flat portion includes one of a flat semicircular surface or a saw-tooth shaped semicircular surface.

10. A flow guide to lower noise level when guiding an air flow to a fan, comprising:

a main guide portion to guide the air flow toward the fan, the main guide portion having a semicircular flange portion to cause a first distance to be maintained between the fan and the main guide portion; and a secondary guide portion positioned where the air flow rate through the fan is greater, the secondary guide portion having a semicircular flat portion completing a circle with the semicircular flange portion such that the distance between the fan and the secondary guide portion where the secondary guide portion is positioned is greater than the first distance, wherein the semicircular length of the flange portion is longer than the semicircular length of the flat portion, wherein the semicircular flat is formed at a section of the secondary guide portion where air flows through an inlet port of the flow guide, and wherein the secondary guide portion is formed in the range of about 240°~330° with respect to a starting point of a scroll inside the flow guide.

11. The flow guide according to claim 10, wherein the semicircular flat portion includes one of a flat semicircular surface or a saw-tooth shaped semicircular surface.

12. An airflow control apparatus, comprising:

a circular plate shaped body;

a circular inlet hole formed through a center portion of the circular plate; and a flow guide extending around a predetermined partial portion of an inner edge of the circular plate where the circular inlet hole is formed, and a flat section extending around the remaining portion of the circular plate to complete a circle with the flow guide, wherein the flat section is formed at a section of the flow guide where air flows through the inlet hole, and wherein the remaining portion is formed in the range of about 240°~330° with respect to a starting point of a scroll inside the flow guide.

13. The air flow control apparatus according to claim 12, wherein a remaining portion of the inner edge of the circular plate where the circular inlet is formed has a saw-tooth shaped design which points inward toward a center of the circular inlet hole.

14. The air flow control apparatus according to claim 12, further comprising:

a circular grill formed within the circular inlet hole to reinforce the circular plate.

* * * * *